US008286311B2

(12) United States Patent
Paik

(10) Patent No.: US 8,286,311 B2
(45) Date of Patent: Oct. 16, 2012

(54) BUCKLE

(76) Inventor: Jisook Paik, Seoul (KR)

( * ) Notice: Subject to any disclaimer, the term of this patent is extended or adjusted under 35 U.S.C. 154(b) by 629 days.

(21) Appl. No.: 12/290,492

(22) Filed: Oct. 31, 2008

(65) Prior Publication Data

US 2010/0107370 A1 May 6, 2010

(51) Int. Cl.
*A44B 11/25* (2006.01)

(52) U.S. Cl. ..... 24/614; 24/615

(58) Field of Classification Search ..... 24/614–615, 24/625

See application file for complete search history.

(56) References Cited

U.S. PATENT DOCUMENTS

| | | | | |
|---|---|---|---|---|
| 6,351,876 | B1 * | 3/2002 | Uehara | 24/625 |
| 6,460,232 | B2 * | 10/2002 | Maruoka | 24/615 |
| 7,318,259 | B2 * | 1/2008 | Uehara | 24/615 |
| 7,426,771 | B2 * | 9/2008 | Patrizi et al. | 24/307 |
| 7,841,345 | B2 * | 11/2010 | Guney et al. | 128/207.11 |
| 2002/0040514 | A1 * | 4/2002 | Uehara et al. | 24/614 |
| 2006/0090310 | A1 * | 5/2006 | Uehara et al. | 24/614 |

FOREIGN PATENT DOCUMENTS

| | | |
|---|---|---|
| KR | 1988-000092 | 3/1988 |
| KR | 1989-000111 | 3/1989 |
| KR | 1990-0009982 | 10/1990 |
| KR | 10-0475493 | 2/2005 |

* cited by examiner

*Primary Examiner* — Robert J Sandy
*Assistant Examiner* — Matthew Sullivan
(74) *Attorney, Agent, or Firm* — Jordan and Hamburg LLP

(57) ABSTRACT

The present invention relates to a buckle that includes a male latch having an improved shape. An object of the present invention is to provide the buckle that includes a projected part formed on a hook of the male latch, where the projected part has three projected surfaces projected from three side surfaces of the arm. The buckle comprises: the male latch including a pair of hooks each of which has three projected surfaces; and a female receptacle coupled to the male latch by holding the projected surfaces formed on the each hook of the male latch, where the male latch is inserted into the female receptacle.

13 Claims, 5 Drawing Sheets

BUCKLE

BACKGROUND OF THE INVENTION

1. Field of the Invention

The present invention relates to a buckle whose female receptacle and male latch can be coupled to each other, and more particularly, to a buckle that includes a male latch having an improved shape.

2. Description of the Related Art

Generally, a buckle has been widely used in a waist belt, a knapsack for climbing, or a shoulder strap of a school bag and includes a female receptacle and a male latch.

The buckle includes a female receptacle and a male latch that are detachably connected to each other. A pair of hooks are formed at the male latch and a receiving part having elasticity is formed at the female receptacle to receive the hook of the male latch. Each of ends of the female receptacle and male latch is provided with a connector to be coupled to an end of the belt or shoulder strap (hereinafter, referred to as "belt").

FIGS. 1 to 3 show various constructions of conventional buckles. The conventional buckles are comprised of female receptacles 12*a*, 12*b* and 12*c* and male latches 11*a*, 11*b* and 11*c* respectively.

A guide projection is formed at the middle of each of the male latch 11*a*, 11*b* and 11*c* and a pair of hooks are formed at both sides thereof.

Each of the female receptacles 12*a*, 12*b* and 12*c* is provided with an insertion part (not shown) into which the guide projection and hooks are inserted. A receiving part is formed at both sides of the female receptacle so as to be connected to the hooks of the male latch.

On the other hand, the female receptacle and male latch can be connected with the belt by the connector formed at ends thereof.

Operation of the above conventional buckle will be explained below.

The male latches 11*a*, 11*b* and 11*c* and female receptacles 12*a*, 12*b* and 12*c* are made of plastic for elasticity. Accordingly, arms 14*a*, 14*b* and 14*c* and projected parts 13*a*, 13*b* and 13*c* of the hooks of the male latches are inserted into the receiving parts of the female receptacles while they are deformed toward guide projections at the middle thereof. In this time, when the hook is located in the receiving part of the female receptacle, the hook is restored to an original state and thus the projected part 13*a*, 13*b* and 13*c* is engaged with a hooked projection of the receiving part. Thus, the male latch and female receptacle are coupled to each other.

To the contrary, when the hook of the male latch 11*a*, 11*b* or 11*c* located in the receiving part of the female receptacle 12*a*, 12*b* or 12*c* is pushed inward by a user, the projected part 13*a*, 13*b* or 13*c* of the hook is released from the hooked projection of the receiving part, thereby allowing the female receptacle and male latch to be separated from each other.

However, in the conventional buckle, a projected surface of the projected part 13*a*, 13*b* or 13*c* of the hook to be contacted to the hooked projection of the receiving part is formed at one or two side surfaces. Accordingly, coupling force between the male latch and female receptacle is weak and thus the male latch may be separated from the female receptacle even by low external pressure.

For example, as shown in FIG. 1, it is disclosed in the registered Korean Patent publication No. 0452565 that a projected part 13*a* of a hook of a male latch 11*a* is extended likely to surround an outer surface of an arm 14*a* with different heights. The hook of the male latch 11*a* includes a 'V' shaped protruded surface that surrounds only an upper surface of the arm 14*a*, that is, the whole first surface, and both side surfaces, that is, very small portions of second and third surfaces of the arm. A projected part 13*b* of a hook of a conventional male latch 11*b* shown in FIG. 2 is extended in the same height from the both side surfaces, that is, second and third surfaces of the arm. In addition, a projected part 13*c* of a hook of a conventional male latch 11*c* shown in FIG. 3 is formed of a rectangular protruded surface extended in the same height from an upper surface, that is, a first surface of the arm 14*c*.

In other words, the projected parts 13*a*, 13*b* and 13*c* of the conventional buckles are projected from one or two side surfaces and thus contact surface with the hooked projection is small. Accordingly, there is a problem that coupling force between the projected part and hooked projection is reduced.

In addition, in the above conventional buckles, the projected part of the male latch is formed of only one or two protruded surfaces and thus force is less distributed. Accordingly, when excessively strong force is applied from the belt, the projected parts 13*a*, 13*b* and 13*c*, or the hooked projection of the female receptacle may be damaged to cause the buckle to be released.

BRIEF SUMMARY OF THE INVENTION

Accordingly, an object of the present invention is to provide a buckle that includes a projected part formed on a hook of a male latch, where the projected part includes three projected surfaces projected from three side surfaces of an arm.

Additional advantages, objects, and features of the invention will be set forth in part in the description which follows and in part will become apparent to those having ordinary skill in the art upon examination of the following or may be learned from practice of the invention.

According to an aspect of the present invention, there is provided a buckle, which comprises: a male latch including a pair of hooks each of which has three projected surfaces; and a female receptacle coupled to the male latch by holding the projected surfaces formed on the each hook of the male latch, where the male latch can be inserted into the female receptacle.

The male latch may include a first end connected to a first belt and a pair of hooks each of which is extended from the first end and respectively have three projected surfaces at an end thereof.

The female receptacle may include: a second end connected to a second belt; an insertion part formed at the opposite side to the second end where the pair of hooks are inserted into the insertion part; and a receiving part that makes the three projected surfaces formed at the end of the each hook to be projected out of the insertion part and fixes the projected surfaces.

Each hook may include an arm extended from the first end, and a projected part having the three projected surfaces that are projected from three side surfaces of the arm at the end of the arm.

The projected part may include a first projection having a first projected surface projected from a first surface forming an upper surface of the arm, a second projection having a second projected surface projected from a second surface forming a left surface of the arm, and a third projection having a third projected surface projected from a third surface forming a right surface of the arm.

The three projected surfaces of the projected part may be inclined at a predetermined angle about a direction perpendicular to a length direction of the arm.

An upper part of each projected surface of the projected part may be rounded.

The projected part may further include a support part projected in the direction opposite to the first projection.

The male latch may further include a guide projection that is extended from the first end and interposed between the pair of hooks.

The first projection may be formed to be stepped from the second and third projections.

The receiving part may be formed in a shape of being curved toward the middle of the female receptacle from edges of both side surfaces thereof.

A hooked projection supporting the three projected surfaces may be formed on a surface facing an open surface of the insertion part among the four surfaces forming the receiving part.

A support member supporting the hooked projection may be formed on a surface inward from the hooked projection on an inner surface of the female receptacle.

A guide for the guide projection may be formed inside the female receptacle.

BRIEF DESCRIPTION OF DRAWINGS

The above objects, other features and advantages of the present invention will become more apparent by describing the preferred embodiments thereof with reference to the accompanying drawings, in which.

DETAILED DESCRIPTION OF THE INVENTION

Figure 1:
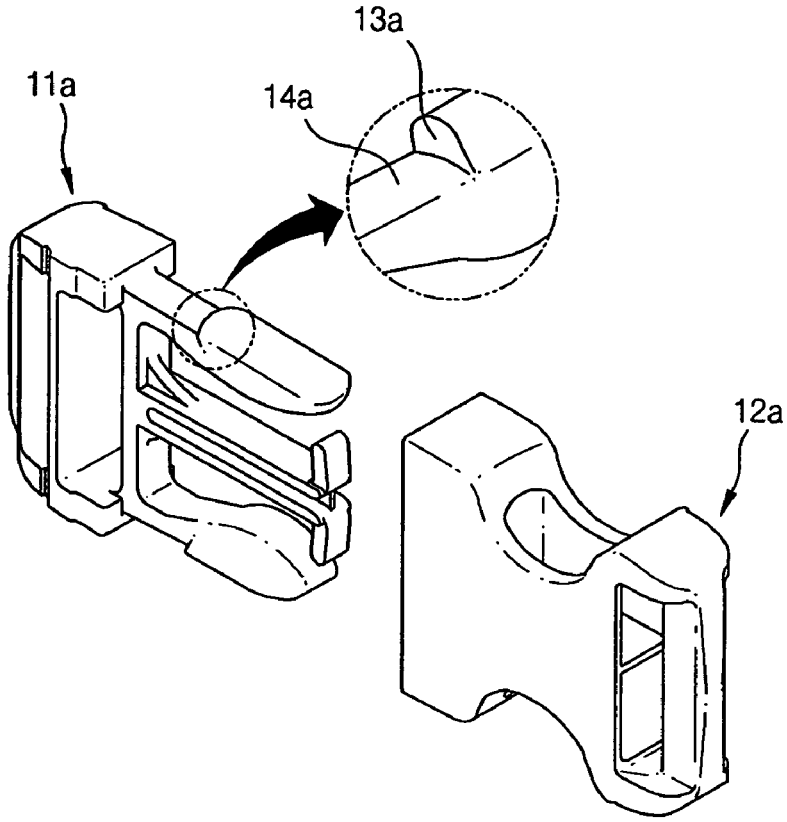
Fig. 1 Related Art
FIGS. 1 to 3 are exemplary views illustrating various constructions of conventional buckles.
Figure 2:
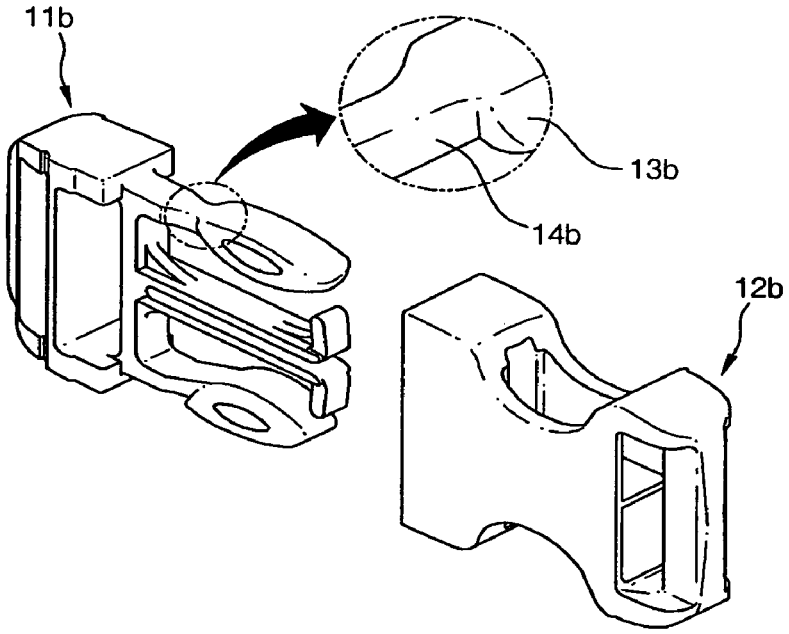
Fig. 2 Related Art
Figure 3:
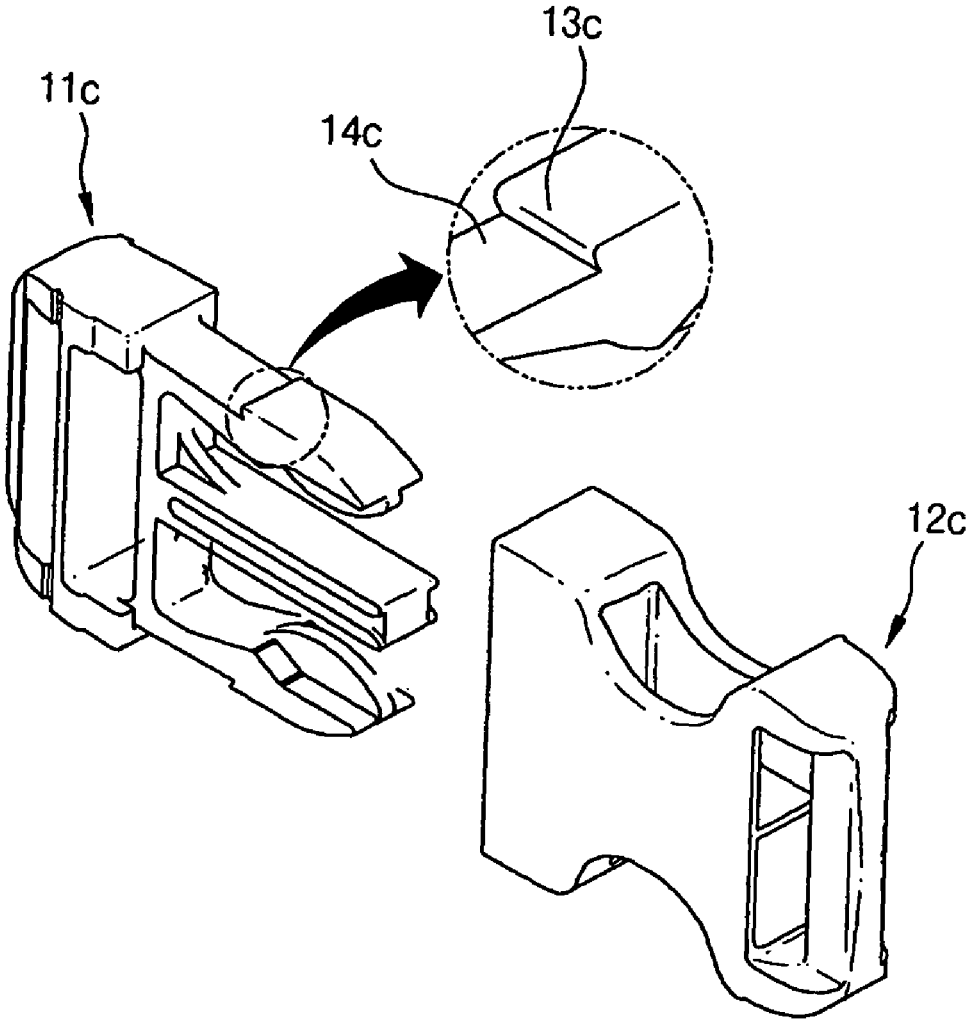
Fig. 3 Related Art

Hereinafter, preferred embodiments of the present invention will be described in detail with reference to the accompanying drawing. The aspects and features of the present invention and methods for achieving the aspects and features will be apparent by referring to the embodiments to be described in detail with reference to the accompanying drawings. However, the present invention is not limited to the embodiments disclosed hereinafter, but can be implemented in diverse forms. The matters defined in the description, such as the detailed construction and elements, are nothing but specific details provided to assist those of ordinary skill in the art in a comprehensive understanding of the invention, and the present invention is only defined within the scope of the appended claims. In the entire description of the present invention, the same drawing reference numerals are used for the same elements across various figures.

Figure 4:
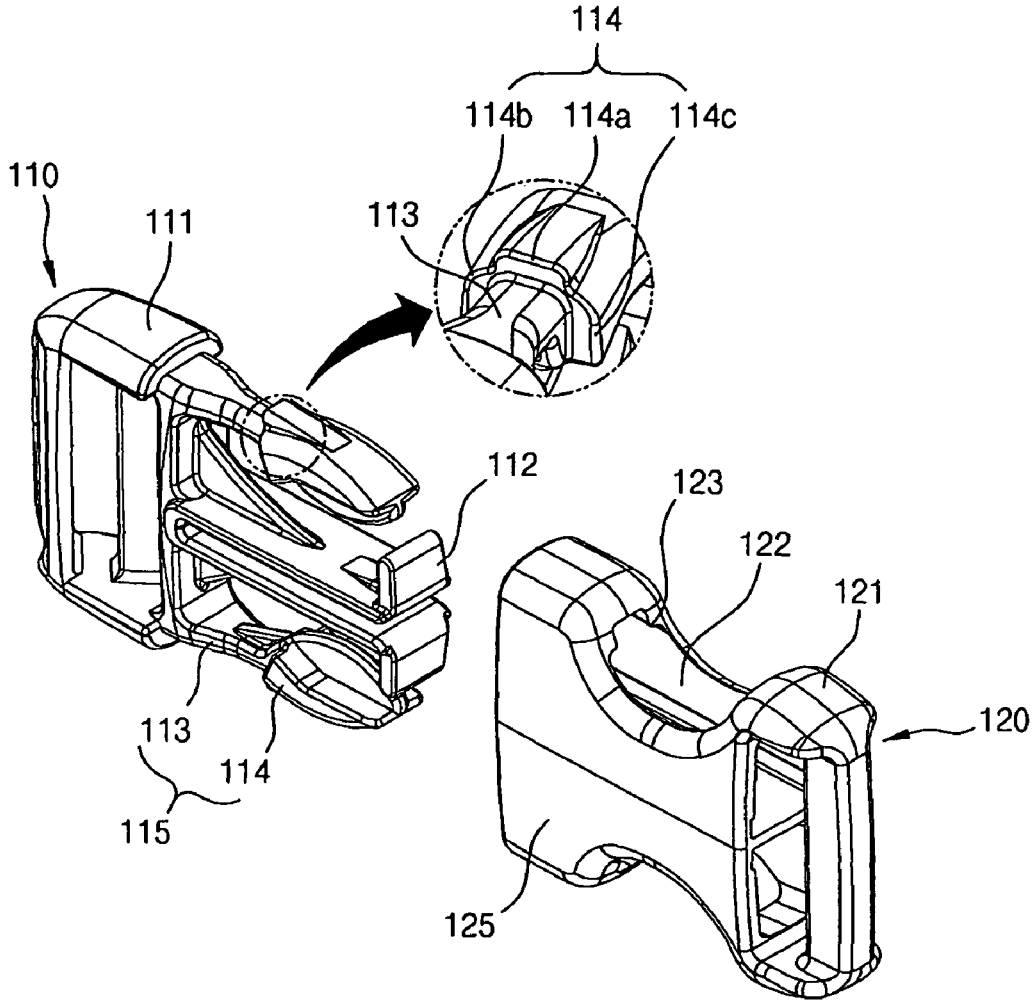
FIG. 4 is a perspective view illustrating a state that a male latch and a female receptacle of a buckle according to the present invention are separated from each other.
Figure 5:
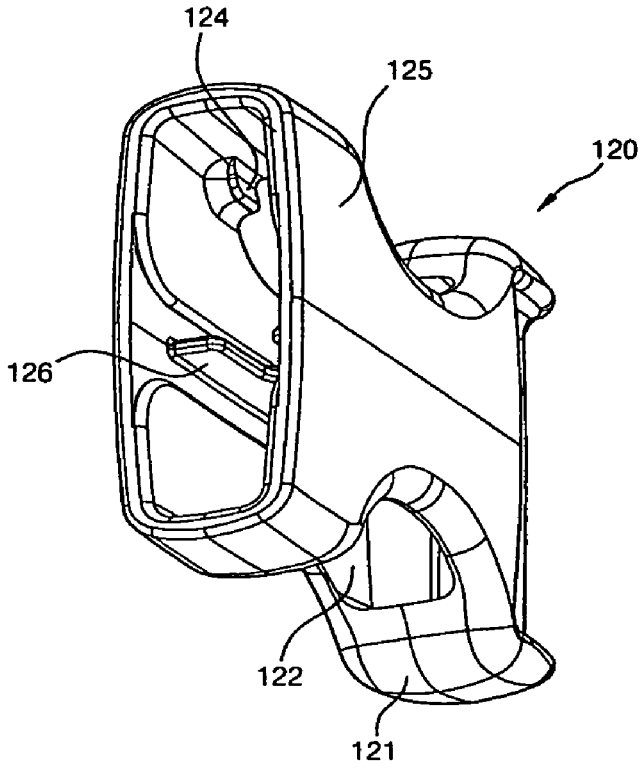
FIG. 5 is a detailed perspective view illustrating the female receptacle shown in FIG. 4.

FIG. 4 is a perspective view illustrating a state that a male latch and a female receptacle of a buckle according to the present invention are separated from each other and FIG. 5 is a detailed perspective view illustrating the female receptacle shown in FIG. 4.

As shown in FIG. 4, the buckle includes a male latch 110 and a female receptacle 120. It is desirable that the male latch 110 and female receptacle 120 are made of plastic material to secure elasticity.

The male latch 110 includes a first end 111 coupled to a belt, a guide projection 112 projected from the middle of the first end and a pair of hooks 115 projected from both side surfaces of the first end about the guide projection. Particularly, the hooks are formed to be coupled to the female receptacle.

The first end 111 of the male latch is coupled to the belt. As shown in FIG. 4, a connector is formed at one side of the first end and the belt can be inserted and fixed in the connector. The guide projection and pair of hooks are projected at the other side of the first end.

The guide projection 112 is formed at the middle between the pair of hooks. A reference position for insertion into the female receptacle is determined by the pair of hooks. However, the guide projection may not be formed.

The hooks 115 are projected from both side surfaces of the first end about the guide projection and actually coupled to the female receptacle by being inserted into the female receptacle. As shown in FIG. 4, the hook includes an arm 113 extended from the first end and a projected part 114 having three projected surfaces projected from three side surfaces at the end of the arm.

In other words, the projected part 114 includes a first projection 114*a* having a first projected surface projected from an upper surface of the arm, that is, a first surface, a second projection 114*b* having a second projected surface projected from a left surface of the arm, that is, a second surface, and a third projection 114*c* having a third projected surface projected from a right surface of the arm, that is, a third surface.

The hooks are coupled to the female receptacle 120 by being inserted therein. The female receptacle includes a second end 121 coupled to the belt, an insertion part 125 formed at the opposite side to the second end in order to receive the pair of hooks and guide projection of the male latch, and a receiving part 122 that makes the projected parts of the hooks inserted through the insertion part 125 to be projected out of the insertion part and fixes the each projected part.

The second end 121 of the female receptacle is coupled to the belt. As shown in FIG. 4, a connector is formed at one side of the second end and the belt can be inserted and fixed in the connector.

The insertion part 125 is formed to have an open surface at the opposite side to the second end. The pair of hooks (and guide projection) are inserted through the open surface of the insertion part. On the other hand, when the guide projection is formed at the male latch, a guide 126 may be further provided to guide the guide projection 112. In other words, the pair of hooks formed at both sides of the guide projection can be exactly inserted into the receiving part by aligning the guide projection by the guide.

The receiving part 122 is provided to make the projected parts 114 formed at the hooks inserted through the insertion part to be projected out of the insertion part and simultaneously prevent the projected parts from being separated from the female receptacle. The receiving part is formed in a shape of being curved toward the middle of the female receptacle from edges of both side surfaces thereof. In addition, the outside and inside of the female receptacle are communicated with each other through the curved portion. Accordingly, the projected parts inserted into the female receptacle through the insertion part can be projected out of the female receptacle through the receiving part.

On the other hand, as shown in FIG. 4, a hooked projection 123 having a shape similar to the projected part is formed on a surface facing an open surface of the insertion part among the surfaces forming the receiving part 122 in order to make the projected parts to be projected out of the receiving part and prevent the projected parts from being separated from the receiving part. The hooked projection may be formed in the same shape as the three projected surfaces so as to allow the projected parts to pass through or be hooked.

In addition, as shown in FIG. 5, a support member 124 supporting the hooked projection is formed on the surface inward from the hooked projection, that is, on the inner surface of the female receptacle where the hooked projection is formed. In other words, the hooked projection should have higher durability than other portions because force is applied to the hooked projection when it is coupled to the projected parts. Accordingly, the support member 124 may be additionally provided the surface inward from the hooked projection.

Figure 6:
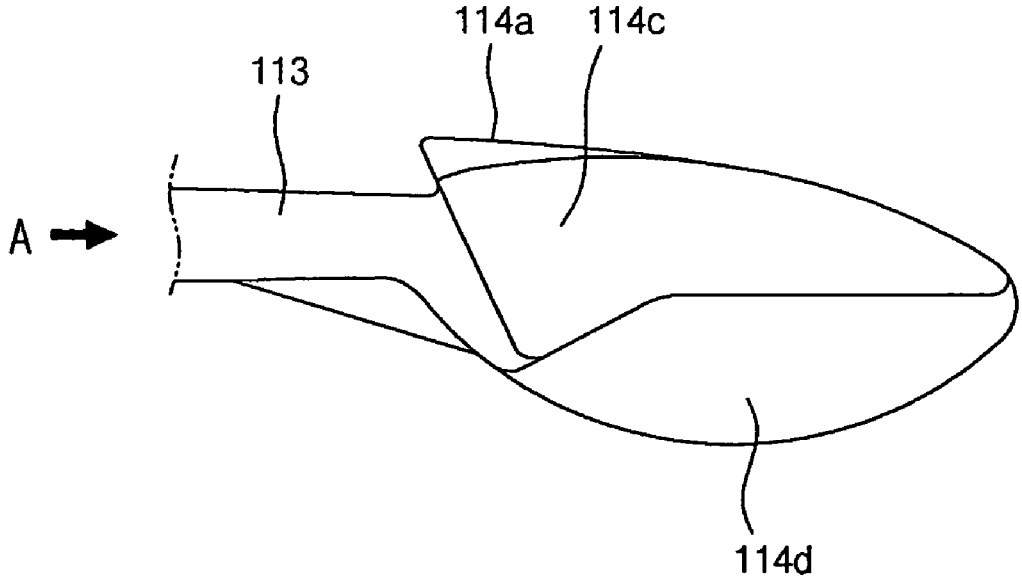
FIG. 6 is a detailed exemplary view illustrating a hook of the male latch shown in FIG. 4.

FIG. 6 is a detailed exemplary view illustrating a right surface of the hook of the male latch shown in FIG. 4.

The hook 115 of the male latch are projected from both side surfaces of the first end and actually coupled to the female receptacle by being inserted into the female receptacle.

The hook 115 includes the arm 113 extended from the first end thereof and the projected part 114 having projected surfaces projected the end of the arm. Particularly, the projected part 114 has three projected surfaces. In other words, a first projection 114*a* forming a first projected surface of the projected part is projected from an upper surface of the arm, and a third projection 114*c* forming a third projected surface of the projected part is projected from the right surface of the arm.

A second projection 114*b* forming a second projected surface of the projected part is projected from the left surface of the arm. The second projection 114*b* is formed at the side opposite to the third projection 114*c* and thus not shown in FIG. 6.

As shown in FIG. 6, the projected surfaces of the projected part are inclined at a predetermined angle about a direction perpendicular to the length direction of the arm. In other words, the projected surfaces of the projected part may be perpendicular to the surface of the arm. However, the projected surfaces of the projected part may have a predetermined angle (less than 90°) in order to increase surface area or distribute force more efficiently.

On the other hand, a supporting part 114*d* projected downward a lower part of the projected part in FIG. 6 supports the projected part. In other words, the supporting part 114*d* is connected to all of the first to third projected parts, thereby supporting them.

Figure 7:
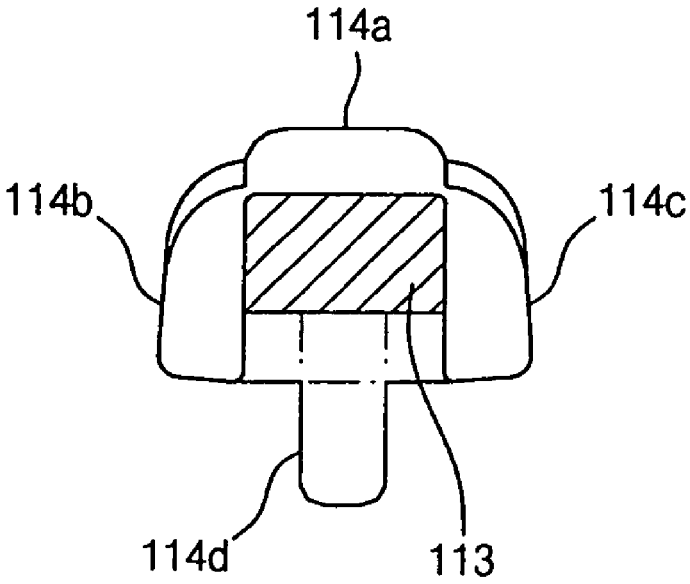
FIG. 7 is another detailed exemplary view illustrating the hook of the male latch shown in FIG. 4.

FIG. 7 is another detailed exemplary view illustrating the hook of the male latch shown in FIG. 4 and particularly shows a sectional surface of the hook when it is observed in the direction of "A" of FIG. 6.

In other words, FIG. 7 shows the shape of the projected part of the hook in more detail and particularly shows the sectional surface of the hook when it is observed in the direction of "A" of FIG. 6 after the arm is cut.

Accordingly, a hatched portion of FIG. 7 is the sectional surface of the cut arm 113. A portion projected over the arm is the projected surface of the first projection 114*a*. A portion projected to the left of the arm is the projected surface of the second projection 114*b*. A portion projected to the right of the arm is the projected surface of the third projection 114*c*, and a portion projected below the arm is a supporting part 114*d*. In addition, round surfaces formed on the second and third projections 114*b* and 114*c* are shown because upper surfaces of the second and third projected parts are projected upward in round shape.

On the other hand, upper surfaces of the first to third projected parts may form in one continuous round surface but, in the embodiment, are stepped in the shape of stairs. In other words, boundary surfaces between the first and second projections 114*a* and 114*b* and between first and third projections 114*a* and 114*c* are stepped as shown in FIG. 7. The above construction of the present invention may be helpful to design and to save materials.

Figure 8:
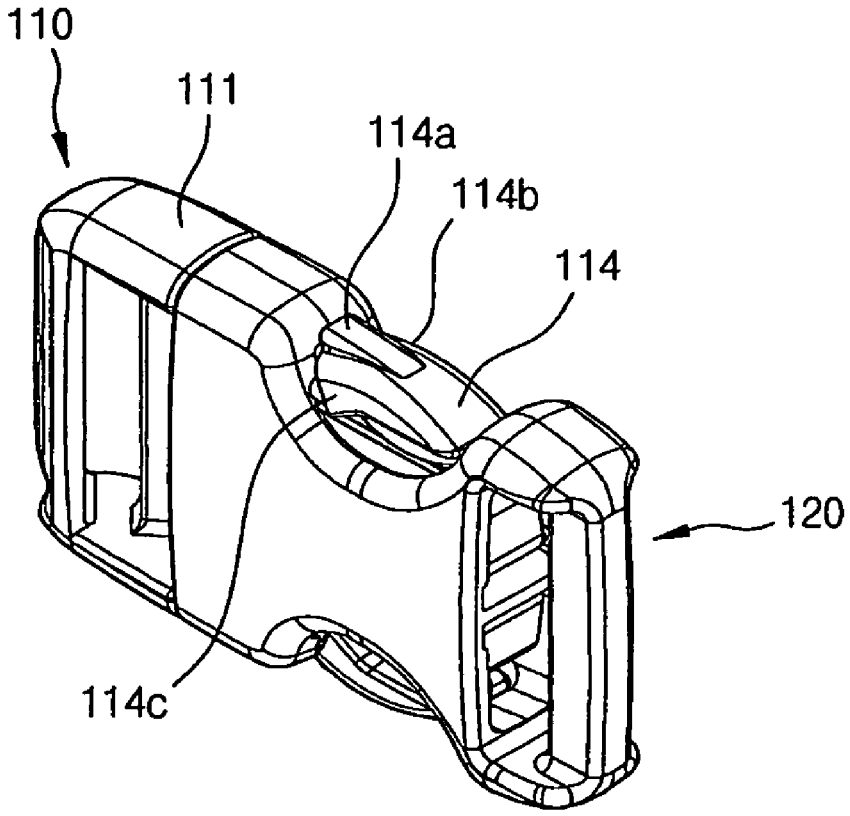
FIG. 8 is a perspective view illustrating a state that the male latch and female receptacle of the buckle are coupled to each other.

FIG. 8 is a perspective view illustrating a state that the male latch and female receptacle of the buckle shown in FIG. 4 are coupled to each other. Operation method of the buckle will be explained below with reference to FIGS. 4 to 8. For convenience of explanation, it is assumed that the guide projection is formed at the buckle. However, the guide projection may not be formed at the buckle.

When a user wants to combine the male latch 110 and female receptacle 120 with each other, first the user inserts one pair of hooks of the male latch and the guide projection 112 into the insertion part 125 of the female receptacle 120. In this time, the guide projection may be guided by the guide 126 formed on the inner surface of the female receptacle.

On the other hand, when the projected part 114 is inserted into the insertion part and then fitted in the receiving part, the projected part 114 is deformed in the direction of the guide projection at the middle thereof. In other words, the hooked projection 123 of the receiving part 122 is closer to the center of the female receptacle rather than the position of the projected part inserted through the insertion part. Accordingly, the projected part passed through the hooked projection is bent in the direction of the guide projection, that is, in the direction of the center of the female receptacle. Thus, the arm 113 supporting the projected part is also bent in the direction of the center of the female receptacle.

However, when the projected part 114 passes through the hooked projection completely and then reaches the opening of the receiving part 122, the arm 113 formed of elastic body is deformed to the original position, that is, to the direction of the outer edge of the female receptacle by restoring force. Accordingly, the projected part 114 is also restored to the original position.

When the projected part is restored to the original position, the projected part is hooked on the hooked projection of the receiving part. Accordingly, the male latch and female receptacle are combined with each other. In other words, the three projections 114*a*, 114*b* and 114*c* of the projected part are hooked on the hooked projection and thus cannot be returned toward the insertion part, thereby keeping the male latch and female receptacle combined with each other.

Next, when the user wants to separate the male latch 110 and female receptacle 120 from each other, the user pushes the projected part 140 of the male latch 110 located in the receiving part 122 of the female receptacle 120 toward the inside of the female receptacle.

Then, the arm is also bent toward the inside of the female receptacle because the arm is formed of elastic body as described above. Accordingly, the projected part 114 passes through the hooked projection of the receiving part and thus the male latch can be separated from the female receptacle.

The arm 113 of the male latch separated from the female receptacle is restored to the original shape by restoring force.

It should be understood by those of ordinary skill in the art that various replacements, modifications and changes in the form and details may be made therein without departing from the spirit and scope of the present invention as defined by the following claims. Therefore, it is to be appreciated that the above described embodiments are for purposes of illustration only and are not to be construed as limitations of the invention.

The buckle according to the present invention produces the following effects.

First, the projected part formed at the hook of the male latch has three projected surfaces at three side surfaces of the arm and thus the coupling area with the female receptacle is increased. Accordingly, the coupling force of the buckle is increased.

Second, the force is distributed to the three projected surfaces, thereby preventing the projected part of the male latch or the hooked projection of the female receptacle from being damaged.

It should be understood by those of ordinary skill in the art that various replacements, modifications and changes in the form and details may be made therein without departing from the spirit and scope of the present invention as defined by the following claims. Therefore, it is to be appreciated that the above described embodiments are for purposes of illustration only and are not to be construed as limitations of the invention.

What is claimed is:

1. A buckle, comprising a male latch and a female receptacle:

the male latch comprised of a pair of hooks, each one hook of the pair of hooks extending distally from a first end, respectively, of said one hook, said each one hook having an arm portion extending longitudinally from the first end and a hooking portion distal to the arm portion at a distal end opposite the first end, wherein each hooking portion includes a first hooking projection having a first surface that projects transversely outward relative to an outer surface of the arm portion in a first direction, a second hooking projection having a second surface that projects transversely outward relative to the outer surface of the arm portion in a second direction different from the first direction, and a third hooking projection having a third surface that projects transversely outward relative to the outer surface of the arm portion in a third direction than the first direction and generally opposite the second direction; and the female receptacle configured to be coupled to the male latch by holding each of the first, second and third hooking projections of each one hook of the pair of hooks while the male latch is inserted into the female receptacle, wherein said first, second, and third surface of the first, second and third hooking projections, respectively, hook a corresponding surface at the female receptacle, each said corresponding surface blocking movement of said first, second and third hooking projection at said first, second and third surface, respectively, when the male latch and female receptacle are pulled in opposing directions.

2. The buckle of claim 1, wherein the male latch is further comprised of:

a male latch first end configured to connect to a first belt, wherein the pair of hooks extend from the first end, and the first, second and third hooking projections are provided at an end of each of the hooks.

3. The buckle of claim 1, wherein the female receptacle comprises:

a second end configured to connect to a second belt;

an insertion part formed at the opposite side to the second end, where the pair of hooks are inserted into the insertion part; and a receiving part between the second end and the insertion part, the receiving part receiving the first, second and third hooking projections of each hooking portion, the receiving part having a first opening through which the first, second and third hooking projections of one hook project and having a second opening through which the first, second and third hooking projections of another hook project.

4. A buckle, comprising:

a male latch comprised of a pair of hooks, each hook comprising an arm extended from a first end, and a hooking portion at a distal end of the arm distal to the first end, wherein each hooking portion includes three hooking projections, each one of the three hooking projections projecting outward in a differing direction relative to a projecting direction of others of the three hooking projections, said each one projecting respectively from a respective differing side surface of the arm; and a female receptacle configured to be coupled to the male latch by holding each of the three hooking projections of each of the pair of hooks while the male latch is inserted into the female receptacle;

wherein the hooking portion of each hook comprises:

a first hooking projection of the three hooking projections projected from a first surface forming an upper surface of the arm;

a second hooking projection of the three hooking projections projected from a second surface forming a left surface of the arm; and a third hooking projection of the three hooking projections projected from a third surface forming a right surface of the arm, wherein the upper surface of the arm of one hook of the pair of hooks is the surface of the arm distal to the arm on the other hook of the pair of hooks, and for each hook the left and the right surfaces are surfaces opposing each other that each meet the upper surface along a direction that the hooks extend from the first end.

5. The buckle of claim 1, wherein for each hooking portion the first, second and third hooking projections are inclined at a predetermined angle about a direction perpendicular to a length direction of the arm having said arm distal end at which the hooking portion is.

6. The buckle of claim 1, wherein upper parts of the first, second and third hooking projections of each hooking portion are rounded.

7. The buckle of claim 1, wherein the hooking portion of each hook further comprises a support part projected in the direction opposite to the first hooking projection.

8. The buckle of claim 2, wherein the male latch further comprises a guide projection that is extended from the male latch first end and interposed between the pair of hooks.

9. The buckle of claim 1, wherein boundary surfaces between the first hooking projection and the second hooking projection and between the first hooking projection and the third hooking projection are stepped.

10. The buckle of claim 3, wherein the receiving part is formed in a shape curved toward a middle of the female receptacle from edges of side surfaces of the female receptacle.

11. The buckle of claim 3, wherein the female receptacle comprises a first and second hooked projection respectively adjacent the receiving part first opening and second opening toward the insertion part and against which respective corresponding hooking portions of the male latch are hooked to restrict movement of the male latch in an extraction direction while the male latch and female receptacle are mated, wherein each one of the first, second and third hooking projections of one hooking portion hook onto the first hooked projection and each one of the first, second and third hooking projections of another hooking portion hook onto the second hooked projection.

12. The buckle of claim 11, wherein for each of the first and second hooked projection of the female receptacle a corresponding support member is formed on a surface inward from the corresponding hooked projection on an inner surface of the female receptacle.

13. The buckle of claim 8, wherein a guide for the guide projection is formed inside the female receptacle.

* * * * *